US008190042B1

(12) United States Patent
Egert, Jr. et al.

(10) Patent No.: US 8,190,042 B1
(45) Date of Patent: May 29, 2012

(54) ELECTROPHOTOGRAPHIC PRINTING APPARATUS

(75) Inventors: Richard F. Egert, Jr., Lumberton, NJ (US); Matthew J. Davies, Parsipanny, NJ (US); Bert T. Archer, Philadelphia, PA (US)

(73) Assignee: Oki Data Americas, Inc., Mount Laurel, NJ (US)

( * ) Notice: Subject to any disclaimer, the term of this patent is extended or adjusted under 35 U.S.C. 154(b) by 516 days.

(21) Appl. No.: 12/466,819

(22) Filed: Jul. 15, 2009

Related U.S. Application Data

(60) Provisional application No. 61/053,837, filed on May 16, 2008.

(51) Int. Cl.
*G03G 15/00* (2006.01)

(52) U.S. Cl. ..... 399/45

(58) Field of Classification Search ..... 399/45, 399/151

See application file for complete search history.

(56) References Cited

U.S. PATENT DOCUMENTS

| | | | | |
|---|---|---|---|---|
| 3,355,308 | A | 11/1967 | Walkup | |
| 4,315,081 | A | 2/1982 | Kobayashi et al. | |
| 5,867,322 | A | 2/1999 | Morton | |
| 5,968,667 | A | 10/1999 | Assante et al. | |
| 5,989,686 | A | 11/1999 | Song et al. | |
| 6,284,839 | B1 | 9/2001 | Fahey et al. | |
| 6,373,637 | B1 | 4/2002 | Gulick, Jr. et al. | |
| 6,460,993 | B2 | 10/2002 | Pilu | |
| 6,465,080 | B2 | 10/2002 | Xing et al. | |
| 6,486,937 | B2 | 11/2002 | Morton et al. | |
| 6,528,567 | B1 | 3/2003 | Arai et al. | |
| 6,657,005 | B1 | 12/2003 | Nishihata et al. | |
| 6,972,871 | B2 | 12/2005 | Tsuda et al. | |
| 7,852,563 | B2 * | 12/2010 | Mizutani et al. | 359/620 |
| 7,872,805 | B2 * | 1/2011 | Mizutani et al. | 359/620 |
| 2001/0017649 | A1 | 8/2001 | Yaron | |
| 2002/0097492 | A1 | 7/2002 | Cobb et al. | |
| 2005/0003223 | A1 | 1/2005 | Koga et al. | |
| 2006/0051109 | A1 | 3/2006 | Lim et al. | |
| 2006/0082880 | A1 | 4/2006 | Lissotschenko | |
| 2008/0102256 | A1 | 5/2008 | Liguzinski et al. | |
| 2009/0231716 | A1 | 9/2009 | Mizutani et al. | |

FOREIGN PATENT DOCUMENTS

| | | | |
|---|---|---|---|
| EP | 0583766 | A1 | 2/1994 |

(Continued)

OTHER PUBLICATIONS

European Search Report for the related European Application No. 09155145.7 dated Jun. 30, 2009.

(Continued)

*Primary Examiner* — David Gray
*Assistant Examiner* — Rodney Bonnette
(74) *Attorney, Agent, or Firm* — Panitch Schwarze Belisario & Nadel LLP

(57) ABSTRACT

A system for manufacturing a 3-D display device is disclosed. The system includes a lenticular image former capable of generating a color lenticular image from a plurality of two dimensional color images, and an electrophotographic printing apparatus configured to receive the color lenticular image from the lenticular image former and to print a CMYK half tone color lenticular image on a surface of a polymeric lenticular lens medium using a powder type toner such that each color when it is printed on the surface of the lenticular lens medium has a printing density of at least 1.0.

33 Claims, 10 Drawing Sheets

FOREIGN PATENT DOCUMENTS

| | | | |
|---|---|---|---|
| EP | 0897126 | A2 | 2/1999 |
| JP | 09-015766 | A | 1/1997 |
| WO | 0063016 | A1 | 10/2000 |
| WO | 02074539 | A1 | 9/2002 |
| WO | 2007114527 | A1 | 10/2007 |

OTHER PUBLICATIONS

European Search Report for the related European Application No. 09155142.4 dated Jul. 3, 2009.

Office Action for the related U.S. Appl. No. 12/402,536 dated Mar. 22, 2010.

Office Action for the related U.S. Appl. No. 12/402,026 dated Mar. 25, 2010.

Keithley Model 6105 Resistivity Adapter Instructions Manual; Publication Data: Oct. 1972; Document No. 31415; 8 pages.

HP Indigo press 5500 product description; Hewlett-Packard Development Company, L.P.; 2007; 8 pages.

A print-out from Hewlett-Packard website entitled "HP Launches Lenticular 3-D Application in EMEA for HP Indigo s2000 Users"; Hewlett-Packard Development Company, L.P.; Jan. 24, 2006; 2 pages.

A print-out from Hewlett-Packard website entitled "DIOSS Expends into Lenticular Markets with its HP Indigo press s2000"; Hewlett-Packard Development Company, L.P.; Jan. 31, 2007; 2 pages.

R. Barry Johnson et al.; Advances in lenticular lens arrays for visual display; Current Developments in lens Design and Optical Engineering VI, Proceeding of SPIE, vol. 5874, Paper 5874-06, San Diego (Aug. 2005).

* cited by examiner

ELECTROPHOTOGRAPHIC PRINTING APPARATUS

CROSS-REFERENCE TO RELATED APPLICATIONS

This application is entitled to and claims the benefit of the priority pursuant to 35 U.S.C. §119(e) of U.S. Provisional Patent Application No. 61/053,837, filed May 16, 2008, the disclosure of which is hereby incorporated by reference in its entirety.

BACKGROUND OF THE INVENTION

1. Field of the Invention

This invention is directed to electrophotographic printing and more particularly to an apparatus and method for electrophotographic printing of a lenticular image on a lenticular lens medium.

2. Background

There is an increasing interest in products which provide a 3-dimensional (3-D) visualization of an image. These products include for instance, posters, business cards, point of sale displays, album covers for CD's, book covers, greeting cards, toys, and all types of promotional items.

Generally, such products providing 3-D images use a transparent lenticular lens as a medium for creating the 3-D image. A lenticular lens generally has a front surface consisting of a plurality of parallel semi-cylindrical shaped lenses called lenticules, of which there may be as many as 150 per inch, and a planar rear surface. A lenticular image printed directly on or affixed to the rear surface of the lens results in the creation of a virtual 3-D image viewable from the front surface. Such image may be made to have a variety of characteristics depending upon the particular type of lenticular image which has been printed on or attached to the rear surface of the lenticular lens.

Conventionally, a lenticular lens medium is made of a transparent polymeric material. Polymeric materials lend themselves to manufacture of the lenticular lens medium because of the relative ease by which the lenticular lens medium can be formed by an extrusion process to provide the desired fineness and consistency of the lenticules, transparency, thickness and dimensional stability.

The production of a 3-D device using a lenticular lens medium requires a printing method that can achieve and maintain accurate registration of the lenticular image with the lenticules of a lenticular lens medium, since the quality of the visualized 3-D image depends upon maintaining alignment of the lenticular image as printed on the lenticular lens medium within a portion of a width of a lenticule over the entire length and width of the lenticular lens. The quality of the visualized 3-D image further depends on the density of the lenticular image as printed on the lenticular lens medium.

It is known in the prior art to produce a lenticular based visualization device by first printing the lenticular image on paper or other printable material and then affixing the paper to the rear of the lenticular lens. A problem with this method is that of the amount of time for accurately registering the lenticular image printed on the paper with the lenticules of the lenticular lens. Another problem may arise where the printed-on paper is not uniformly affixed to the lens.

Also, it is known in the prior art to print lenticular images directly on a surface of a polymeric lenticular lens medium using ink by, for example, lithographic offset printing, silk printing, photogravure, typeset printing and inkjet printing. The use of ink requires allowance in the production time for drying of the ink. Further, when printing directly to a polymeric lenticular medium with ink it is necessary to apply an ink absorption/adhesion layer or coating on the lenticular lens medium in order that the ink uniformly adhere to the polymeric medium. Where lithographic printing is used to print a lenticular image on a lenticular medium, substantial investment in set up time and a substantial number of test prints are required in order to initially align and to maintain alignment of the lithographic press with the lenticular medium and thus lithographic printing is economical only for large quantity production runs. Where inkjet printing is employed, the requirement for a high print density (i.e. dots per inch) combined with the need to scan the significant mass of an ink jet cartridge over the surface of the lenticular medium results in a slow throughput of the printed-on lenticular medium.

Electrophotographic printing apparatuses of a type which use a powder toner can print images on paper with high density and high quality at high-speed. Therefore, this type of electrophotographic printing apparatus has been broadly used and commercialized as an output terminal of information processing systems requiring the functions of printing, copying, facsimile and scanning. However, electrophotographic printers which use powder type toners have not heretofore found wide acceptance for printing a lenticular image on a polymeric lenticular lens medium.

What is needed but is not provided by the state of the art is a method for directly printing with a suitable quality and speed, a color lenticular image directly on a polymeric lenticular lens medium such that the creation of a small number of lenticular based visualization devices may be easily, rapidly and economically produced and the cost of the equipment for producing the lenticular based visualization devices be within the economic reach of small printing businesses.

BRIEF SUMMARY OF THE INVENTION

The present invention is directed to improvements to a commercially available electrophotographic printer manufactured by Oki Data Corporation, i.e. Model 9800. The improvements enable the printer to print a lenticular image having a predetermined quality directly on a surface of polymeric lenticular lens. Up until this invention was made, it was not possible to use an electrophotographic printer and a powder toner to print a lenticular image directly to a polymeric lenticular lens with a high predetermined quality. The ability to achieve printing on a polymeric medium of a predetermined quality by an electrographic printer using a powder toner is the direct result of the combination of: (1) a discovery by the inventors that the polymeric material used for the lenticular lens needs to have a volume resistivity of less than a predetermined value in order that a powder type toner adhere uniformly with a high density to the polymeric medium, (2) the development of a new polymeric material by Oki Data Corporation in conjunction with Kureha Corporation that has the requisite volume resistivity, as described in U.S. patent application Ser. No. 12/402,536, which is attached as Appendix A and hereby incorporated into the application in its entirety, (3) the characteristics of a linear light emitting diode array used by the Model 9800 printer which provides a uniform dot size across the span of the lenticular lens medium, and (4) improvements to the alignment and half tone imaging of the Oki Data Corporation Model 9800 printer as further described herein.

Briefly stated, one aspect of the present invention is a color electrophotographic printing apparatus comprising: a medium supplying part configured to hold a polymeric lenticular lens medium; an image pattern generating part configured to receive a color lenticular image and to provide a CMYK half tone lenticular image; an image forming part configured to: (1) receive the lenticular lens medium from the medium supplying part, (2) receive the CMYK half tone lenticular image from the image pattern generating part, and (3) transfer, using a powder type of toner, the CMYK half tone lenticular image to a rear surface of the lenticular lens medium; and a fixing part configured to fix the transferred CMYK image to the lenticular lens medium, wherein each CMYK color when it is transferred to and fixed on the rear surface of the lenticular lens medium has a printing density of at least 1.0.

Another aspect of the present invention is a method of producing a lenticular based visualization device by a color electrophotographic printing apparatus, said printing apparatus including a medium supplying part, an image forming part and a medium ejecting part, the method comprising the steps of: receiving a CMYK lenticular image into the image forming part; receiving a lenticular lens medium from the medium supplying part into the image forming part; transferring the CMYK lenticular image to a surface of the lenticular lens medium; fixing the transferred CMYK image such that each color when transferred to and fixed on the lenticular lens medium has a density of at least 1.0, and providing the lenticular based visualization device to the medium ejecting part.

A further aspect of the present invention is an electrophotographic printing apparatus comprising: a medium supplying part configured to hold a lenticular lens medium having a plurality of lenticules arranged in parallel to each other; an image forming part; and an image pattern generating part configured to receive a lenticular image and to generate from the lenticular image, a half tone lenticular image, said half tone lenticular image being transferrable to the lenticular lens medium by the image forming part, said printing apparatus being configurable to align the lenticules of the lenticular lens medium with the half tone image by altering the angular relationship of the lenticular lens medium held in the image supplying part and the half tone image.

Another aspect of the present invention is a method of calibrating a color electrophotographic printer for printing a lenticular image on a lenticular lens medium, said electrophotographic printer including a medium supplying part and an image forming part, the method comprising the steps of: (a) receiving a CMYK half tone lenticular calibration image into the image forming part; (b) receiving the lenticular lens medium from the medium supplying part into the image forming part; (c) transferring and fixing the CMYK half tone lenticular calibration image to a surface of the lenticular lens medium; (d) evaluating the transferred CMYK half tone lenticular calibration image; and (e) if the evaluation of the transferred and fixed CMYK half tone calibration image is not satisfactory, altering an angular alignment of the at least one of the lenticular lens medium held in the medium supplying part with respect to CMYK half tone calibration image and the CMYK calibration image with respect to the lenticular lens medium held in the medium supplying part.

Another aspect of the present invention is a medium supplying assembly for feeding a medium to an electrographic printer comprising: a feeding roller; a first platform attached to the printer in a plane substantially parallel to the axis of the feeding roller; and a second platform attached to the first platform and pivotal in the plane of the first platform.

Another aspect of the present invention is a lenticular based visualization device comprising a layer of toner particles on a rear surface of a lenticular lens medium, said layer being produced from a powder toner by an electrophotographic printer, said toner layer forming a CMYK half tone lenticular image, the CMYK half tone image having respective screen angles of 105, 75, 30 and 15 degrees.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

A significant problem for forming an image on a polymeric printing medium by inks and by electrophotographic toner is that generally available polymeric materials suitable for extruding into a lenticular lens do not readily absorb ink and/or do not readily allow for particles of toner to adhere to a surface of the polymeric material. A measure of the amount of ink absorbed or toner adhered to the surface is print density, which is commonly understood as being a measure of the amount of light absorbed by a printed image. Print density is an accurate indication of the amount of ink or toner which is deposited on the medium in a half tone printing process used by lithographic, ink jet and electrophotographic printing and is directly related to the quality of the lenticular based image visualized by a viewer.

Figure 1:
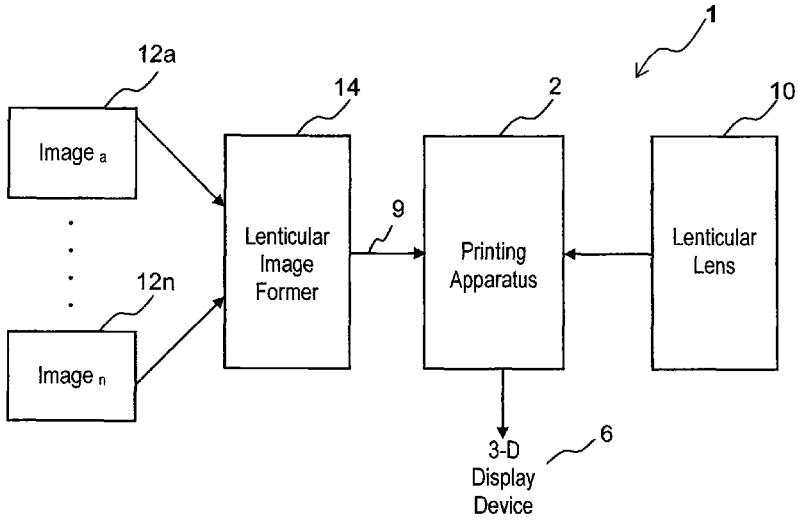
FIG. 1 is a block diagram of a system for producing a lenticular based visualization device.
Figure 3:
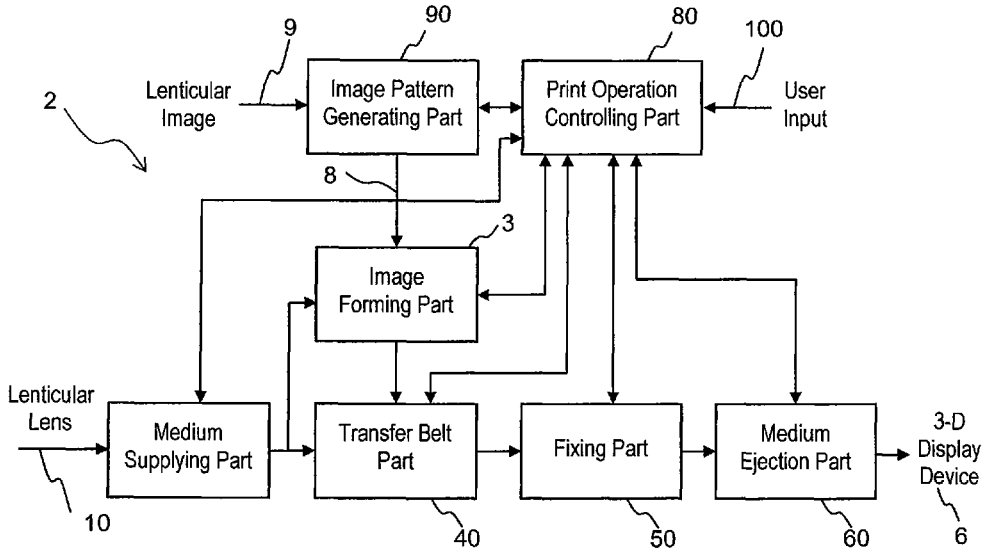
FIG. 3 is a block diagram of a preferred embodiment of an electrophotographic printing apparatus which produces the lenticular based visualization device of FIG. 1.

Referring now to FIG. 1 there is shown a preferred system 1 for manufacturing a lenticular based visualization device 6 (also referred to as a printed-on lenticular lens 6) from a lenticular lens medium 10. The system 1 includes a lenticular image former 14 capable of generating a color lenticular image 9 from a plurality of two dimensional (2-D) color images 12*a*-12*n*, an electrophotographic printing apparatus 2 which is configured to receive the color lenticular image 9 from the lenticular image former 14, and to form a half tone CMYK color lenticular image 8 on a surface of a lenticular lens medium 10 such that each color when it is printed and fixed on the surface of the lenticular lens medium has a predetermined printing density of at least 1.0 and preferably at least 1.4 as measured by the Model X-Rite 528 densitometer manufactured by X-Rite Incorporated. The density of each color may be at least about 1.0, 1.1, 1.2, 1.3. 1.4 and 1.5 including any and all ranges and subranges therein.

The lenticular image former 14 is typically a computer program that resides in a computer (not shown). Preferably, the image former 14 is capable of generating a lenticular image 9 which when viewed through the lenticular lens medium 10, provides the viewer with an image that appears to have one or more of depth; a flip image, i.e. an image that changes from one image to another as a person moves by the lenticular based visualization device 6; an animation image, i.e. a multiple flip image which simulates movement; and a morph image, which is similar to a flip image but having a fade between the images. The lenticular image former 14 may execute in a separate computer or may be incorporated into the printing apparatus 2. The specific set of 2-D images 12*a*-12*n* received by the image former is determined by the desired visual effect. The images 12*a*-12*n* may be virtual images stored in a computer memory or may originate from a medium or mediums and scanned photographically so that they become stored in digital form in the computer memory. Preferably, the 2-D images 12*a*-12*n* are color images but may be black and white images, with or without gray scale.

Preferably, the lenticular image former 14 includes: (1) a user interface which provides the user with the capability of inputting the desired features of the lenticular based visualization device 6, and (2) processing for creating the lenticular image 9 based on the desired features. The methods for creating the lenticular image 9 are well known and available commercially and for that reason the methods for forming a lenticular image 9 by the image former 14 will not be described herein. Software which is commercially available includes that from, e.g., ProMagic Software.

Figure 2A:
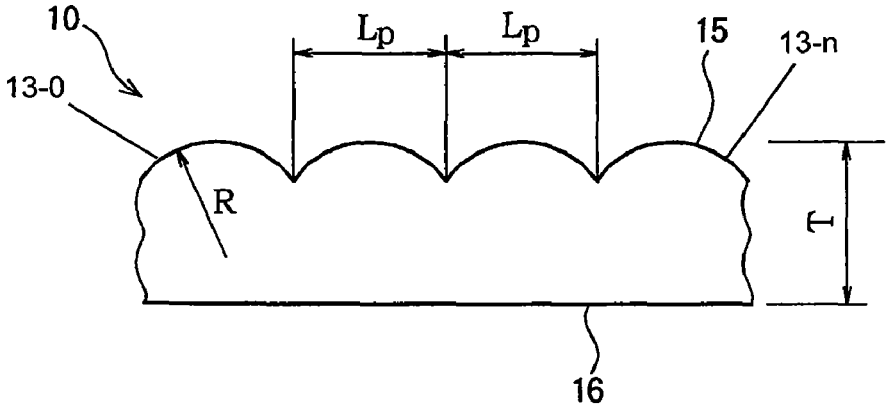
FIG. 2A is a cross sectional view of a lenticular lens medium.
Figure 2B:
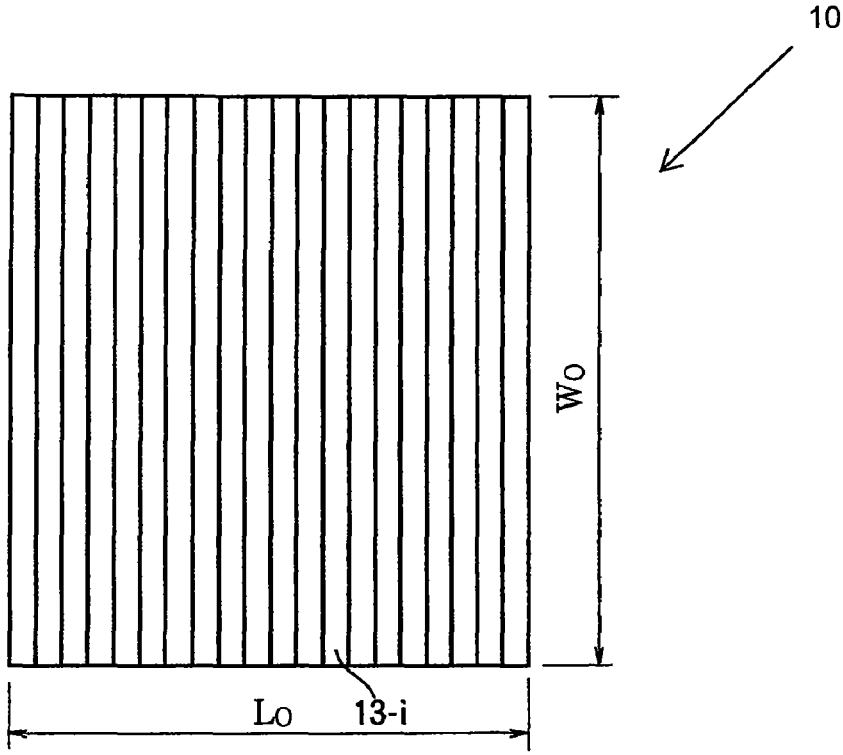
FIG. 2B is a plan view of the lenticular lens medium of FIG. 2.

As shown in FIGS. 2A and 2B, the lenticular lens medium 10 used by the printer 2 includes a plurality of semi-cylindrical-shaped or arc-shaped elongated convex parts 13-0 to 13-*n*. More specifically, the lenticular lens medium 10 has on its front side a concavo-convex surface 15 where linear convex 'lenses (hereafter referred to as lenticules 13) having a semi-cylindrical-shaped or arc-shaped cross section are arranged in parallel to each other, and a substantially planar printing surface 16 on a rear side. Preferably, the lenticular lens medium 10 is formed of a polymeric material having a volume resistivity less than $1\times10^{14}$ ohm-cm' and preferably in the range of $1\times10^{7}$-$1\times10^{14}$ ohm-cm as measured between the concavo-convex surface 15 and the printing surface 16, and a surface resistivity in the range of $1\times10^{8}$-$1\times10^{15}\Omega/\square$. As shown in FIG. 2A, the width of each linear convex lens of the concavo-convex surface 15 is Lp and the pitch expressed as lines per inch (LPI) equals 1/Lp. The thickness of the lenticular lens medium 10 is expressed as T inches, and the radius of each linear convex lens is expressed as R inches. The lens pitch LPI, the lens radius R and the medium thickness T are respectively determined according to application or function. For cases of close viewing or fine, detailed viewing, a fine pitch lens (high number of lenticules 13 per inch (LPI) is used. Conversely for cases of broad viewing, a coarse pitch lens (low LPI) is used. In the preferred embodiment, the LPI of the lenticular lens medium 10 is approximately 75 lines per inch but the system 1 is capable of producing a lenticular based imaging device 6 having pitch of the lens 10 as low as 30 LPI and as high as 150 LPI. Preferably, the thickness of the lenticular lens medium 10 is approximately 0.3 mm. However, the thickness of the lenticular lens medium 10 which is printable by the printer 2 could be as great as 0.9 mm. Preferably, the lenticular lens medium 10 has a nominal length Wo of 19 inches and a nominal width Lo of 13 inches. However, the printer 2 not limited to printing on a lenticular lens medium 10 of 19 by 13 inches but is able to accommodate other sizes of the lenticular lens medium 10.

Preferably, the lenticular lens medium 10 for use with the printer 2 lacks a toner adhesion coating. However, the printer 2 is capable of printing the CMYK half tone color lenticular image 8 on a polymeric material with a print density of at least the predetermined value for each color that is printed when the polymeric material includes a toner adhesion/absorption coating as well as other coatings that may be applied to the lenticular lens medium 10 for protection from scratching, staining, fading etc. and still provide a printing density of 1.4 or greater for each CMYK color.

Figure 2C:
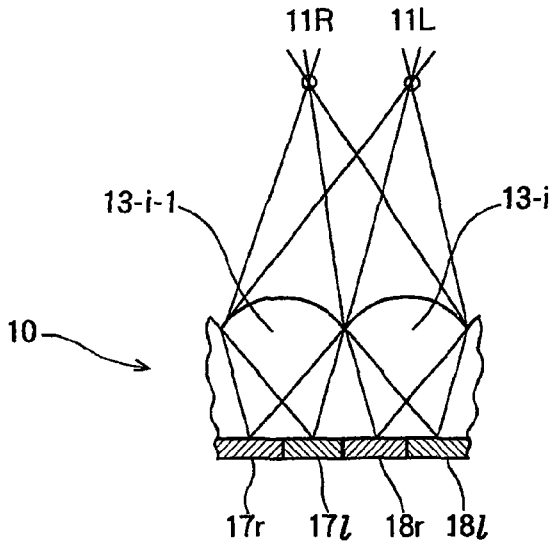
FIG. 2C is a ray diagram of the lenticular lens medium of FIG. 2.

Referring now to FIG. 2C, a brief explanation is given of a principle upon which an image pattern printed on the lenticular lens medium 10 is stereoscopically viewed, with reference to FIG. 2C. The lenticular lens medium 10 is composed of a substantially plate-like member having the concavo-convex surface 15 with a plurality of linear convex lenses 13-0 through 13-*n* and the printing surface 16 opposite to the concave-convex surface 15. An image 8 including printing layers 17*r*, 17*l*, 18*r* and 18*l* is printed on the printing surface 16. In other words, different images are printed on the printing surface 16 of the lenticular lens medium 10 opposite to the linear convex lenses 13-0 through 13-*n*. Therefore, when the printed image is viewed via the linear convex lenses 13-0 through 13-*n* (i.e., from above in FIG. 2C), the left eye 11L (FIG. 2C) views the image of the printing layer 171 by means of the lens 13-*i*-1 and the image of the printing layer 181 by means of the lens 13-*i*. Similarly, the right eye 11R views the image of the printing layer 17*r* by means of the lens 13-*i*-1 and the image of 18*r* by means of the lens 13-*i*. Since the left eye 11L and the right eye 11R view respective different images, a stereoscopic image is viewed due to optical illusion.

Referring now to FIGS. 3-6 there is shown a preferred embodiment of the electrophotographic printing apparatus 2 (hereinafter referred to as printing apparatus 2). The printing apparatus 2 includes a medium supplying part 70 for holding the lenticular lens medium 10 to be printed on, an image pattern generating part 90 configured to receive a color lenticular image 9 from the lenticular image former 14 and to provide a CMYK half-tone lenticular image 8, an image forming part 3, configured to receive the lenticular lens medium 10 from the medium supplying part 70, to receive the CMYK half tone lenticular image 8 from the image pattern generating part 90 and to transfer, using a powder type of toner, the CMYK half tone lenticular image 8 to a surface 16 of the lenticular lens medium 10 and a fixing part (a fixing device) 50 for fixing the CMYK half tone lenticular image 8 to the surface of the lenticular lens medium 10 such that each color when it is printed and fixed on the surface of the lenticular lens medium 10 has a printing density of at least a predetermined value of 1.0 and preferably the print density of at least 1.4.

Preferably, the image pattern generating part 90 receives an RGB color image 9 from the image former 14. However, the received color image could be in another format such as grayscale or CMYK. Preferably, the image pattern generating part 90 generates the CMYK half tone lenticular image 8 to have respective CMYK screen angles of nominally 105, 75, 30 and 15 degrees, such screen angles being selected to eliminate Moiré patterns in the visualized lenticular image.

Preferably, the printing apparatus 2 also includes a transfer belt part 40 including an image transferring part and a medium conveying part, and a medium ejection part 60 for receiving a printed-on lenticular based visualization device 6. The printing operation is controlled by the image pattern generating part 90 which generates the CMYK half tone lenticular images 8, and a printing operation controlling part 80 which accepts user input 100 and controls the sequence, timing and the like of the printing operation. In this regard, the print operation controlling unit 80 controls the feeding the lenticular lens medium 10 into the image forming part 3 by the supplying roller 71, timing of light emission by an exposure device 32 of the image forming part 3, and timing of starting rotation of and applying voltages to a charging roller 33, a photosensitive drum 31, a developing roller 37, and a toner supplying roller 35 of a developing device 30.

In using the printing apparatus 2, the lenticular lens medium 10 is initially placed by a user in an alignment assembly 73 (described below) of the medium supplying part 70. The lenticular lens medium 10 is fed from the alignment assembly 73 to the supplying roller 71 of the medium supplying part 70. The medium supplying roller 71 rotates and conveys the lenticular lens medium 10 towards the image forming part 3 and the transfer belt unit 40. Transfer of the CMYK half tone lenticular image 8 to the surface 16 of the lenticular lens medium 10 is performed by the image forming part 3 and the transfer belt unit 40.

Preferably, the image forming part 3 includes developing devices 30K, 30Y, 30M and 30C, each of which includes a photosensitive drum respectively 31K, 31Y, 31M and 31C, and a respective exposure device 32K, 32Y, 32M and 32C, and the like. The image forming part 3 and the transfer belt 40 transfer a toner image, i.e. CMYK half tone image 8, to the lenticular lens medium 10 being conveyed by the transfer belt unit 40. The CMYK half tone toner image 8 is transferred onto the flat printing surface 16 (opposite to the concavo-convex surface 15 where the linear convex lenses are arranged) of the lenticular lens medium 10 via a series of processes of charging, exposing, developing and transferring. The toner image formed on the flat printing surface 16 is opposite to an erect image which is viewed via the linear convex lenses 13 in an arranging direction of the linear convex lenses 13. The toner layer formed on the printing surface 16 of the lenticular lens medium 10 includes printing layers such as the printing layers 17*r*, 17*l*, 18*r* and 18*l* which are divided in the form of strips as was described with reference to FIG. 2C. It should be appreciated that while the printer 2 is disclosed as having four photosensitive drums 31K, 31Y, 31M and 31C, for printing black, yellow, magenta and cyan, the printer 2 could be constructed with fewer than four drums 31, including only a single photosensitive drum 31, which would be used sequentially to print the four colors or a lesser number of colors.

Figure 5:
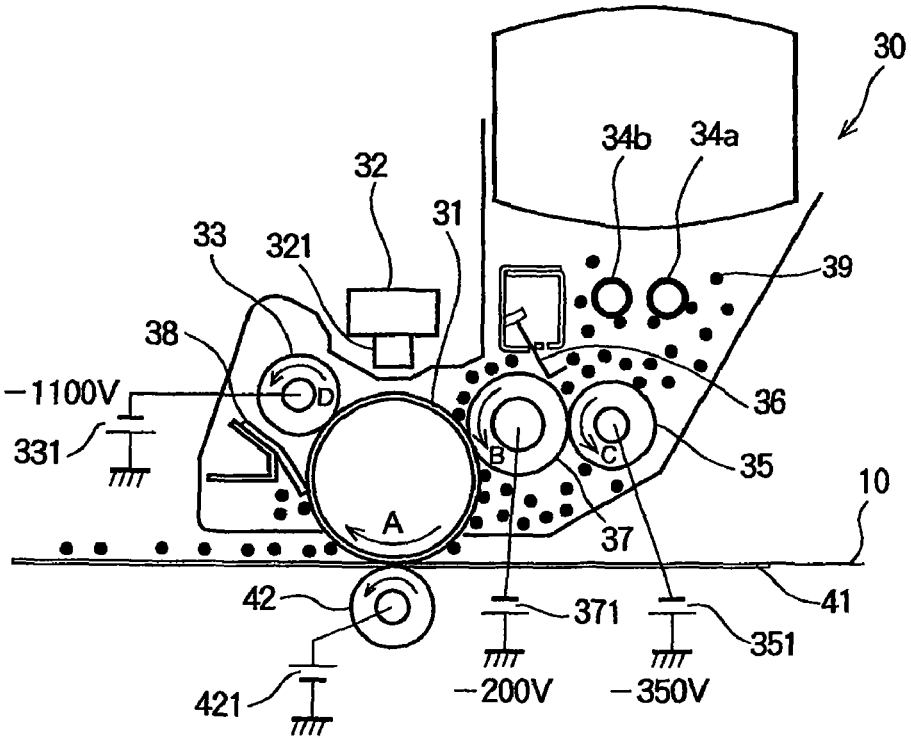
FIG. 5 is a schematic view showing a main part of the electrophotographic printing apparatus which performs a developing process and a transferring process of a toner image in a printing operation on the lenticular lens medium according to the preferred embodiment of the present invention.
Figure 6:
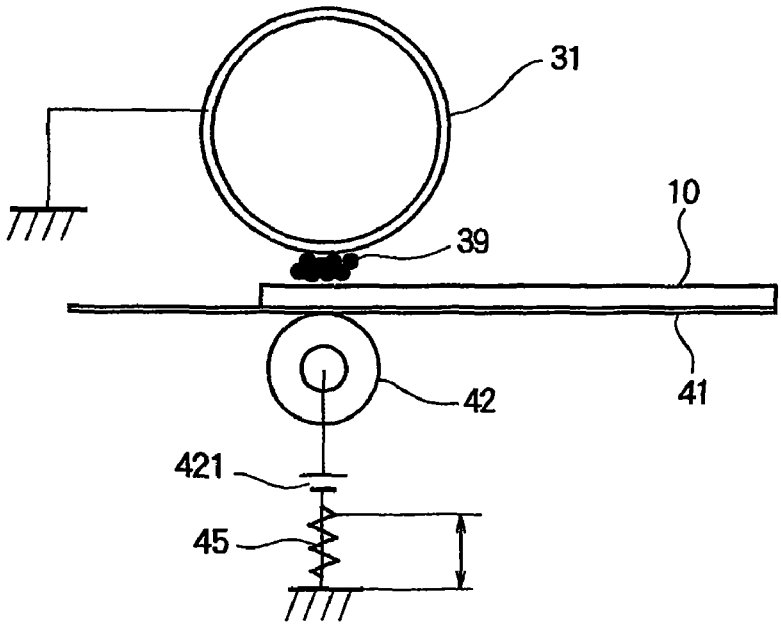
FIG. 6 is a schematic view showing a main part of the electrophotographic printing apparatus which performs the transferring process of the toner image in the printing operation on the lenticular lens medium according to the preferred embodiment of the present invention.
Figure 7:
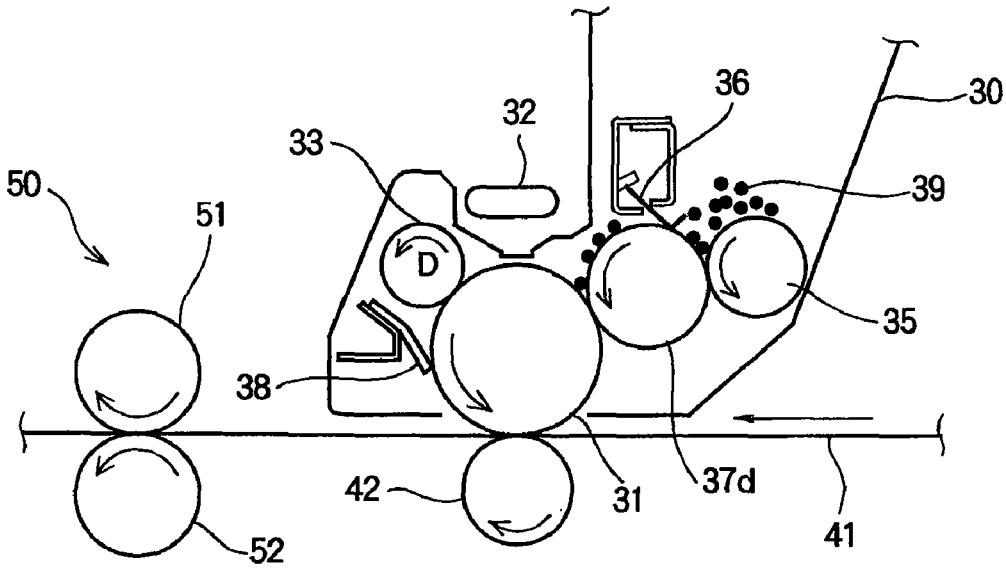
FIG. 7 is a schematic view showing a main part of the electrophotographic printing apparatus which performs the transferring process and the fixing process of the toner image in the printing operation on the lenticular lens medium according to the preferred embodiment of the present invention.

Referring now to FIGS. 5-7, each of the developing devices 30K, 30Y, 30M and 30C of the image forming part 3 have the same configuration, and therefore reference marks for respective colors (K, Y, M, and C) are not used in FIGS. 5 through 7.

As shown in FIG. 5, a charging roller 33 is a substantially cylindrical-shaped rubber roller including a metal shaft and a semi-conductive rubber provided around the metal shaft. Both ends of the metal shaft are mounted to bearings at side walls of the developing device 30. The charging roller 33 is pressed against the photosensitive drum 31 and rotates in the direction shown by arrow D. The shaft of the charging roller 33 is supplied with voltage of approximately −1150 V by a high voltage power supply device 331, so as to charge that the surface of the photosensitive drum 31 to approximately −600 V.

The exposure device 32 used in the exposure process includes LED elements (not shown) and Selfoc lenses 321. The Selfoc lenses focus lights from the LED elements onto the surface of the photosensitive drum 31. The LED elements are arranged in a column or a plurality of columns in a lateral direction, and the number of the LED elements is set according to a resolution of the printing apparatus when a medium with a printable maximum width is used. In the preferred embodiment, approximately 15,000 LED elements are arranged. The exposure device 32 performs ON/OFF control of the respective LED elements according to an image pattern to be printed. When the LED elements emit light, the light passing through the corresponding Selfoc lenses 321 irradiate onto the surface of the photosensitive drum 31 to form spots with predetermined spot diameters (approximately 20 μm when the printing apparatus has the resolution of 1200 DPI) which correspond to the resolution of the printing apparatus 2. Electric charge is induced in a charge generation layer at the irradiated spot of the photosensitive drum 31 due to radiant energy, and the charge moves to the surface of the photosensitive drum 31 to cancel the charge having been generated in the charging process, so that a potential of the irradiated spot becomes approximately zero. As a result, an invisible image (referred to as a latent image) of an approximately zero potential is formed on the surface of the photosensitive drum 31 corresponding to the image pattern irradiated by the LED elements which are arranged substantially linearly throughout a width of a printable area.

Next, in the developing device 30, powder toner particles 39 with mean particle diameter of approximately 5 μm are supplied by a toner cartridge (not shown). Agitating shafts 34*a* and 34*b* are disposed in the developing device 30. Both ends of the respective agitating shafts 34*a* and 34*b* are mounted to bearings at both side walls (not shown) of the developing device 30, and gears are fixed to one ends of the agitating shafts 34*a* and 34*b*. The gears engage a gear fixed to the shaft of a developing roller 37, and are rotated. The toner particles 39 supplied in the developing device 30 are conveyed in the lateral direction in FIG. 5 by the rotation of the agitating shafts 34*a* and 34*b*, so that the distribution of the toner particles 39 in the developing device 30 becomes uniform, and the toner particles 39 adhere to a toner supplying roller 35.

The toner supplying roller 35 is composed of a substantially cylindrical sponge rubber roller including a metal shaft and a semiconducting foam sponge rubber provided around the metal shaft. Both ends of the metal shaft of the toner supplying roller 35 are mounted to bearing at the side walls of the developing device 30 (as is the case with the charging roller 33), and the toner supplying roller 35 is pressed against the developing roller 37.

The developing roller 37 is a substantially cylindrical roller including a metal shaft and a semi-conductive rubber around the metal shaft. A surface layer is provided on the developing roller 37, which contains a substance having a property to negatively charge the toner particles 39 when the substrate contacts the toner particles 39. Both ends of the metal shaft of the developing roller 37 are mounted to bearings at the side walls of the developing device 30 (as is the case with the toner supplying roller 35). The developing roller 37 is pressed against the surface of the photosensitive drum 31 and the toner supplying roller 35.

Gears are fixed to one sides of the metal shafts of the photosensitive drum 31, the developing roller 37 and toner supplying roller 35, and engage each other so that the photosensitive drum 31, the developing roller 37 and the toner supplying roller 35 rotate together with each other respectively in directions as shown in arrows A, B and C in FIG. 5.

The shaft of toner supplying roller 35 is supplied with a voltage of approximately −350 V by a high voltage power supply device 351. The shaft of developing roller 37 is supplied with a voltage of approximately −200 V by a high voltage power supply device 371. The toner supplying roller 35 and the developing roller 37 rotate in the same direction as shown by arrow B and C in a state where the toner supplying roller 35 and the developing roller 37 are pressed against each other. Thus, at an upstream side of a contact portion between the toner supplying roller 35 and the developing roller 37, undeveloped toner adheres to the surface of the developing roller 37. The undeveloped toner is scraped from the developing roller 37 and friction between the toner particles is generated, so that the toner particles are negatively charged. The material of the toner supplying roller 35 is selected among materials that cause the toner particles to be negatively charged due to friction. Due to electric potential difference between the toner supply roller 35 and the developing roller 37 at the contact portion, the toner particles adhere to the surface of developing roller 37 and are conveyed to the downstream side.

A developing blade 36 composed of a thin metal blade (having a thickness of 0.1 mm), is bent at a position of 1.5 mm from a tip of the developing blade 36 to form a curvature portion R. The curvature portion R is pressed against the developing roller 37. At the contact portion between the developing blade 36 and the developing roller 37, a thin toner layer is formed of the toner particles 39 on the surface of the developing roller 37 by means of the developing blade 36. Further, the toner particles 39 contact the toner supplying roller 35 and the developing roller 37 to cause friction, and become electrically charged. In this manner, the toner particles 39 on the developing roller 37 having passed the developing blade 36 form the toner layer having a thickness and electric charge both of which are determined according to a dimension of the curvature portion R of the developing blade 36, a pressure with which the developing blade 36 is pressed against the developing roller 37, a location of the curvature portion R, an installation angle of the developing blade 36, and other factors. For example, the toner particles 39 having passed the developing blade 36 form the toner layer having a uniform thickness of approximately 25 μM and having a toner volume of approximately 0.6 mg/cm$^2$, and is suitably charged to approximately 25 μC/g.

The developing roller 37 and the photosensitive drum 31 are pressed against each other, and respectively rotate in directions shown by arrows A and B opposite to each other. At a contact portion between the developing roller 37 and the photosensitive drum 31, where the latent image is formed on the photosensitive drum 31, a coulomb force is generated by an electric field (caused by the electric potential difference between the developing roller 37 and the photosensitive drum 31) and the electric charge of the toner particles 39 in a direction from the developing roller 37 toward the photosensitive drum 31, so that the toner particles 39 move to the circumferential surface of the drum 31. Since the toner particles 39 move from the developing roller 37 to the latent image on the photosensitive drum 31 corresponding to the image pattern, a visualized image (i.e., the toner image) is obtained. This process is referred to as development. At a portion except for the latent image on the surface of the photosensitive drum 31, an electric field is generated in the opposite direction, i.e., a coulomb force is generated in a direction from the photosensitive drum 31 toward the developing roller 37, and the toner particles 39 do not move from the developing roller 37. The toner particles 39 that do not move from the developing roller 37 are referred to as undeveloped toner. According to the rotation of the developing roller 37, the undeveloped toner, adhering to the developing roller 37, is conveyed to the contact portion between the developing roller 37 and the toner supplying roller 35, and is scraped from the developing roller 37. Meanwhile, the toner particles 39 (i.e., the toner image) having moved to the surface of the photosensitive drum 31 are conveyed to a transferring position according to the rotation of photosensitive drum 31.

The transfer belt unit 40 includes a transfer belt 41 which is a semi-conductive seamless belt (having a thickness of approximately 0.1 mm) supported by two metal rollers 43 and 44. The metal rollers 43 and 44 apply a tension of approximately 6 kg to the transfer belt 41 and cause the transfer belt 41 to rotate. The metal rollers 43 and 44 are supported by bearings at the side walls of the transfer belt unit 40. A gear is fixed to one side of the metal roller 43 and is linked with a motor in the main body of the printing apparatus via gears. The transfer belt 41 is rotated by the rotation of the metal roller 43. The lenticular lens medium 10 having been conveyed by the supplying roller 71 to the image forming part 3 is further conveyed in a longitudinal direction 19 (see FIGS. 9A and 9B) which is perpendicular to a rotational axis of the supplying roller 71 and in a plane substantially parallel to the rotational axis of the supplying roller 71 by the transfer belt 41 of the transfer belt unit 40. Transfer rollers 42 are disposed on the lower side of the transfer belt 41 in opposition to the photosensitive drums 31 of the developing device 30. Each of the transfer rollers 42 is a sponge rubber roller including a metal shaft and a semi-conductive foam sponge rubber provided around the metal shaft, and both ends of the metal shaft are mounted to bearings at side walls of the transfer belt unit 40. The transfer rollers 42 are pressed against the photosensitive drums 31 via the transfer belt 41. This section is referred to as a transferring portion. Gears are fixed to one sides of the metal shafts of the transfer rollers 42, and are linked to a drive motor (not shown) of the main body of the printing apparatus via gears. The transfer rollers 42 rotate at a circumferential speed which is substantially the same as the circumferential speed of the photosensitive drum 31. When the transfer rollers 42 rotate, a voltage of approximately 1000-5000V is applied to the transfer rollers 42 by a high voltage power source device 421, and the voltage is determined by detecting a resistance value of the lenticular lens medium 10 so as to achieve suitable toner transferring efficiency.

Preferably, the resistance value of the lenticular lens medium 10 can be obtained using a method shown in FIG. 6.

In order to obtain the resistance value of the lenticular lens medium 10, a current $I_{TR}$ 46 flowing through a detection resistor R45 is determined by measuring an electric potential difference $V_{TR}$ of the detection resistor R45. The electric current is preliminarily measured in a state where the lenticular lens medium 10 has not yet conveyed to the transferring portion, and the electric current is measured in a state where the lenticular lens medium 10 is inserted into between the photosensitive drum 31 and the transfer belt 41, so that the resistance value of the lenticular lens medium 10 is determined. The determined resistance value is fed back to a controlling unit, and suitable voltage is applied to the transfer rollers 42.

The resistance value of the lenticular lens medium 10 can be obtained using a method shown in FIG. 6. In order to obtain the resistance value of the lenticular lens medium 10, a current $I_{TR}$ 46 flowing through a detection resistor R45 is determined by measuring an electric potential difference $V_{TR}$ of the detection resistor R45. The electric current is preliminarily measured in a state where the lenticular lens medium 10 has not yet conveyed to the transferring portion. The electric current is then measured in a state where the lenticular lens medium 10 is inserted between the photosensitive drum 31 and the transfer belt 41, so that the resistance value of the lenticular lens medium 10 is finally determined. The determined resistance value is fed back to a controlling unit, and suitable voltage is applied to the transfer rollers 42. In this regard, a timing of starting the conveyance of the lenticular lens medium 10 by the supplying roller 71, a timing of light emission by the exposure device 32 of the image forming part 3, timings of starting rotations of and applying voltages to the charging roller 33, the photosensitive drum 31, the developing roller 37, and the toner supplying roller 35 of the developing device 30 are respectively controlled by the controlling unit according to the image pattern to be printed.

In the transferring process, the voltage applied to the transferring roller 42 is distributed according to the resistance value of the lenticular lens medium 10 and the resistance value of the toner image (i.e., the toner particles 39) on the photosensitive drum 31. The toner particles 39 are applied with a coulomb force generated by an electric field acting on the toner particles 39 caused by the applied voltage combined with another electric field in the opposite direction caused by the negatively charged toner particles 39 on the photosensitive drums 31. To be more specific, a force generated by the electric field due to the voltage applied by the transfer roller 42 acts on the toner particles 39 in one direction. Further, a force generated by the electric field due to the charged toner particles 39 on the photosensitive drum 31, an image force with respect to the photosensitive drum 31 and a liquid adhesive force with which the toner particles 39 adhere to the surface of the photosensitive drum 31 act on the toner particles in the opposite direction. These forces are combined and act upon the toner particles 39 forming the toner image. The toner particles 39 existing in a part where the Coulomb force caused by the transfer roller 42 is larger than other forces in the opposite direction are forced to move in the direction away from the photosensitive drum 31 toward the lenticular lens medium 10. Therefore, the toner particles 39 existing in a part where the electric field caused by the transfer roller 42 is large move from the photosensitive drum 31 toward the lenticular lens medium 10, so that the toner image formed by the toner particles 39 is transferred to the lenticular lens medium 10.

The above explanation has been given of the developing device 30 of black (K) as an example, but the image patterns of yellow (Y), magenta (M) and cyan (C) are formed using the respective developing devices 30. The developing devices 30K, 30Y, 30M and 30C are located at different positions, and therefore perform operations with respect to the lenticular lens medium 10 at compensated timings. The toner image patterns are formed on the lenticular lens medium 10 by the developing devices 30K, 30Y, 30M and 30C respectively.

Figure 8:
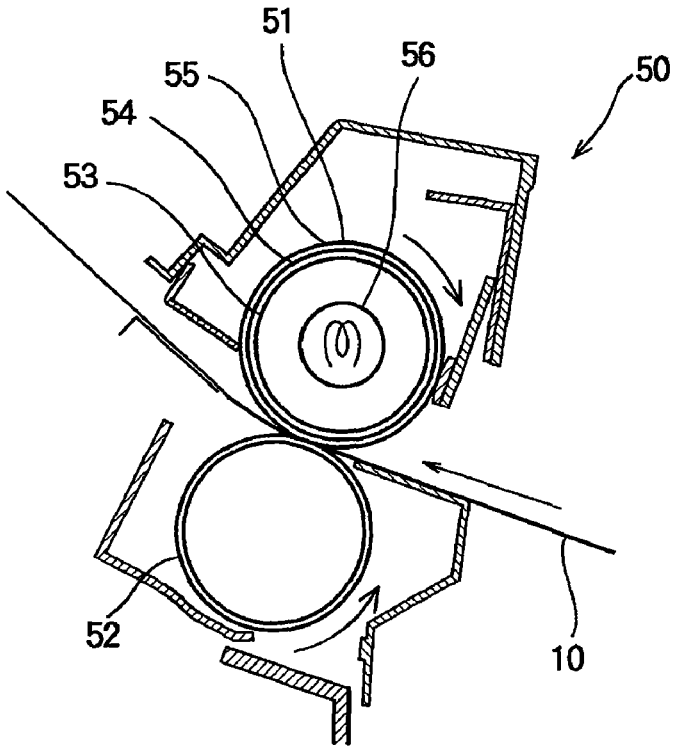
FIG. 8 is a schematic view showing an example of a fixing device used in the fixing process in the printing operation on the lenticular lens medium according to the embodiment of the present invention.

In order to fix the toner image to the lenticular lens medium 10 so as to obtain a usable printing material, the fixing device 50 applies heat and pressure to the toner image so as to cause the toner particles thereof to melt and be fixed to the lenticular lens medium 10. FIG. 8 is a schematic view showing the fixing device 50 of the printing apparatus. The fixing device 50 includes a fixing roller 51 on the upper side and a backup roller 52 on the lower side. The fixing roller 51 includes a halogen lamp 56 at a center portion thereof. The halogen lamp 56 is applied with AC voltage to emit light and heat. The fixing roller 51 further includes a thin iron pipe 53 (having a thickness of 0.15 mm) around the halogen lamp 56 for providing intensity and reducing heat resistance. The fixing roller 51 further includes a thin silicone rubber layer 54 (having a thickness of 1 mm) for providing contact width and reducing heat resistance, and a fluorine coating layer 55 (having a thickness of 0.05 mm) having an excellent toner releasability.

The fixing device 50 applies heat and pressure to the unfixed toner image on the lenticular lens medium 10, so as to cause the toner particles 39 to melt and be fixed to the lenticular lens medium 10. The lenticular lens medium 10 with the toner image of the toner particles 39 having been fixed by the heat fixing process is conveyed from the fixing device 50 toward the medium ejection/stacking part 60. A pair of ejection rollers 61*a* and 61*b* eject the lenticular lens medium 10 out of the main body of the printing apparatus so that the lenticular lens medium 10 is stacked on the medium ejection/stacking part 60.

In order to provide a lenticular based visualization device 6 of a predetermined quality it is necessary that the lenticules 13 of the lenticular lens medium 10 be aligned with the CMYK half tone lenticular image 8. In the preferred embodiment the lenticules 13 are aligned by altering the angle of the lenticular lens medium 10 held in the medium supplying part 70 with respect to CMYK half tone calibration image 8. Alternatively, the alignment of the lenticules 13 of the lens medium 10 can be accomplished by altering the angle of the CMYK calibration image 8 with respect to the lenticular lens medium 10 held in the medium supplying part 70.

Figure 4:
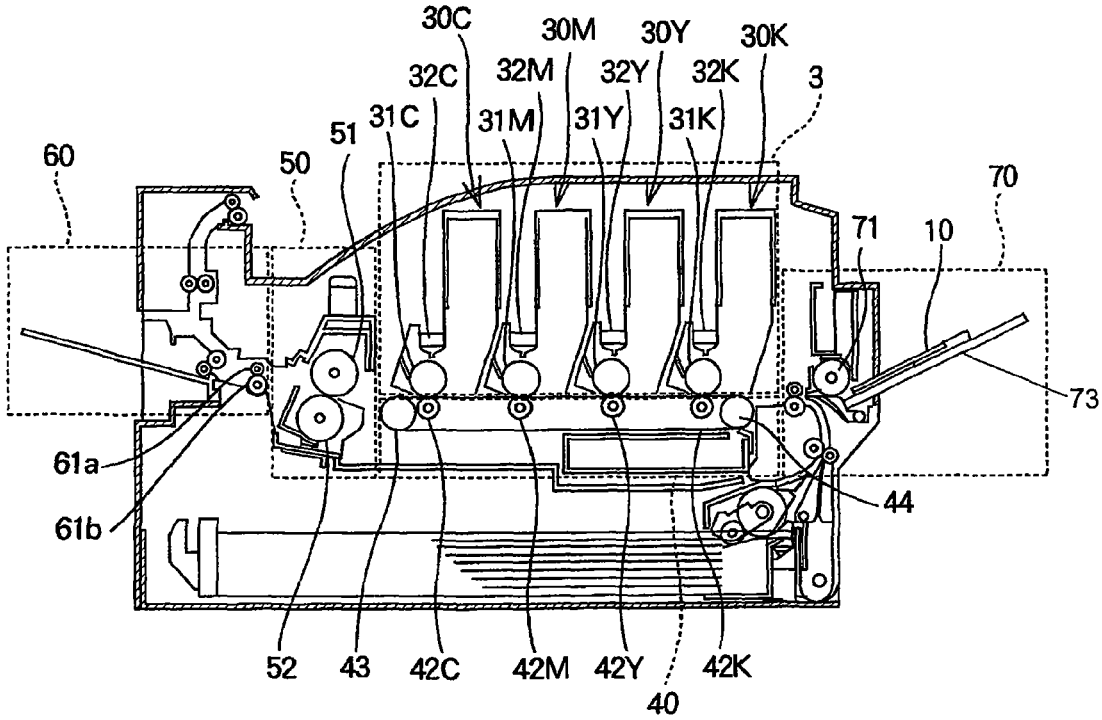
FIG. 4 is a schematic view of the electrophotographic printing apparatus of FIG. 3.
Figure 9A:
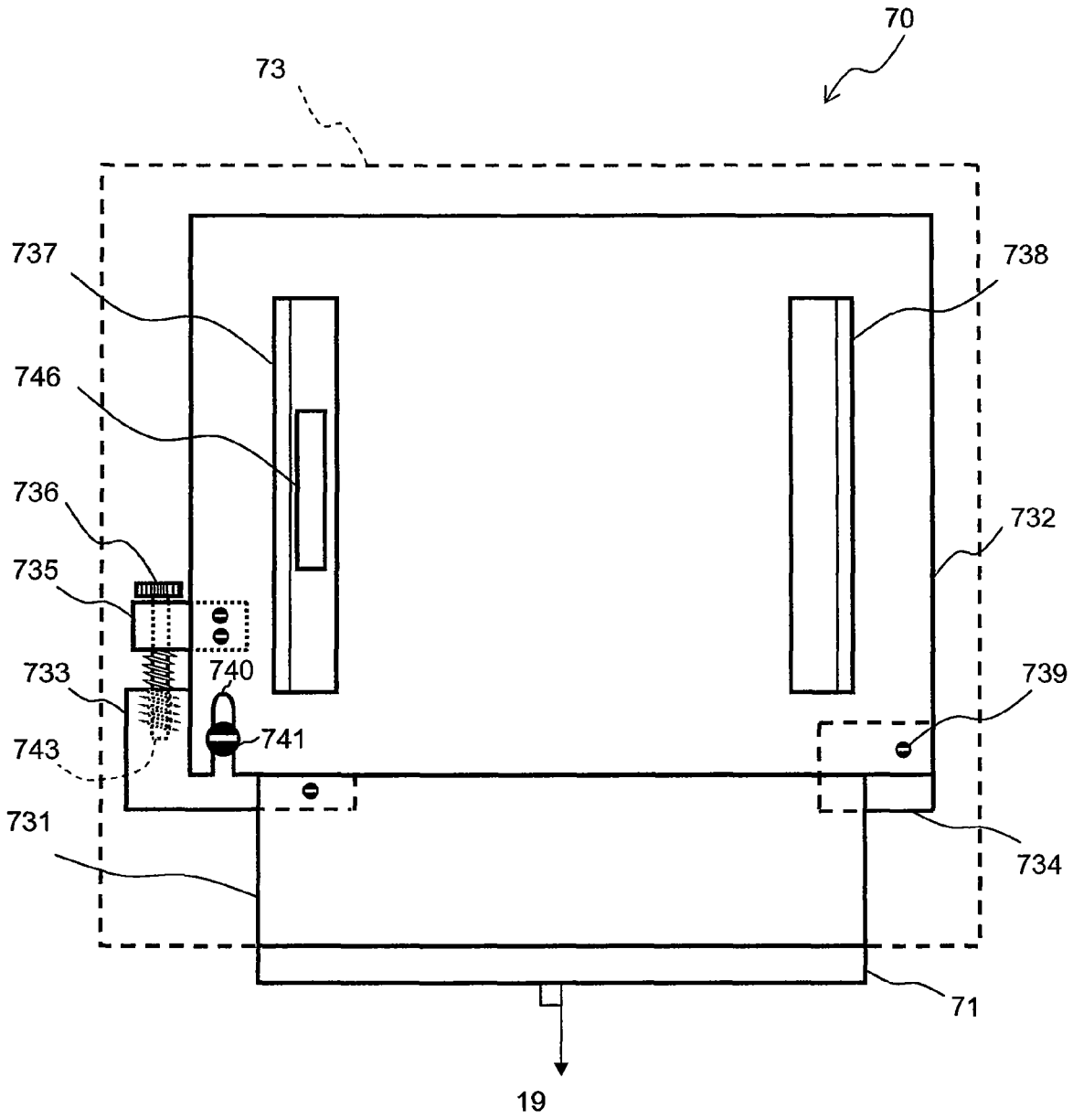
FIG. 9A is a schematic top view of the medium supplying part.
Figure 9B:
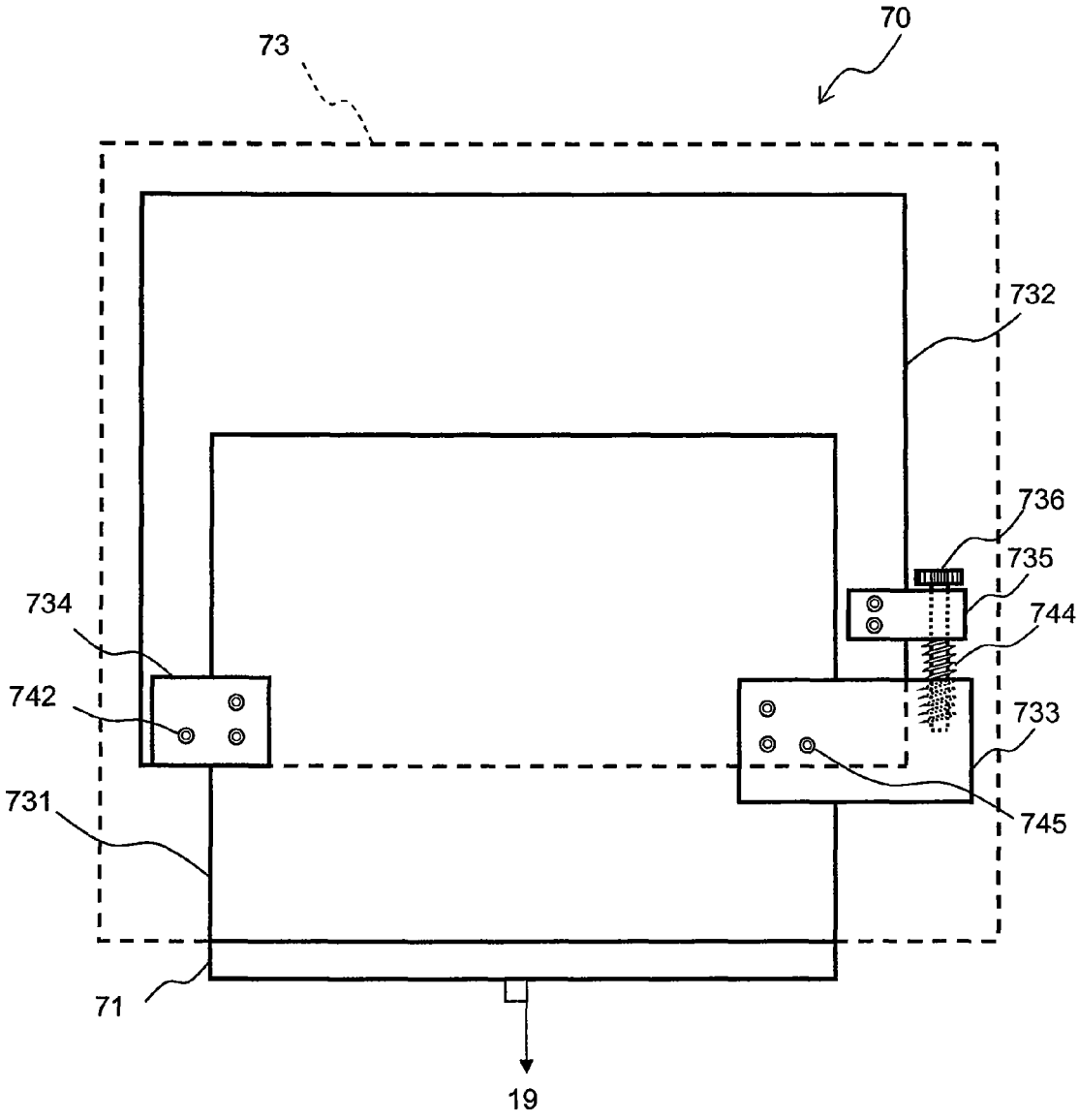
FIG. 9B is a schematic bottom view of the medium supplying part.

As shown in FIG. 4 and FIGS. 9A and 9B the medium supplying part 70 includes the alignment assembly 73 which provides for aligning the lenticular lens medium 10 held in the medium supplying part 70 with the CMYK half tone lenticular image 8. The alignment assembly 73 includes a first platform 731 attached to the printer 2 in a plane substantially parallel to the rotational axis of the feeding roller 71, and a second platform 732 attached to the first platform and pivotal in the plane of the first platform 732. In the preferred embodiment, the alignment assembly 73 is adjustable to feed the lenticular lens medium 10 to the image forming part 3 such that the lenticular lens medium 10 is aligned with the CMYK half tone lenticular image 8 to within one-half the width Lp of a lenticule 13 over the length of the lenticular lens medium 10 as the lenticular lens medium 10 traverses the image forming part 3. The alignment assembly 73 can be an integral part of the medium supplying part 70 or can be a separate assembly, removably attachable to the medium supplying part 70.

The preferred embodiment of the medium alignment assembly 73 also includes a first member 733 fixedly attached to the first platform 731 and a second member 735 fixedly attached to the second platform 732. A thumbscrew 736 is rotatably secured in the second member 735. The thumbscrew 736 extends into a threaded portion 743 of the first member 733. A compression spring 744 surrounds the portion of the thumbscrew 736 which extends between the first member 733 and the second member 735 and bears against the members 733 and 735.

A third member 734 is fixedly attached to the first platform 731. The third member includes a threaded pivot hole 742 forming a pivot point. A threaded stud 739 is inserted through the second platform 732 to engage the threaded pivot hole 742. The second platform also includes a slot 740. A locking screw 741 is inserted through the slot 742 to engage a threaded hole 745 in member 733. The second platform 732 also includes a spring loaded guide rail 737 and a fixed guide rail 738.

In use the lenticular lens medium 10 is placed in the alignment assembly 73 between the spring loaded guide rail 737 and the stationary guide rail 738 such that a reference edge of the lenticular lens medium 10 is against the stationary guide rail 738 and the lenticules 13 are oriented generally parallel to the fixed guide rail 738. While the guide rails 737 and 738 are shown as being fixed in location, the printer 2 may be configured to have guide rails 737 and/or 738 to be movable.

Preferably, the alignment of the lenticules 13 with the lenticular image 10 is held to within one-half of a width of a lenticule 13 as the lenticular lens medium 10 traverses the image forming part 3. In the printing apparatus 2, the alignment of the lenticular lens medium 10, as determined by the alignment assembly 73, is held within the image forming part 3 by the medium supplying roller 71 and the transfer belt 40.

Figure 10:
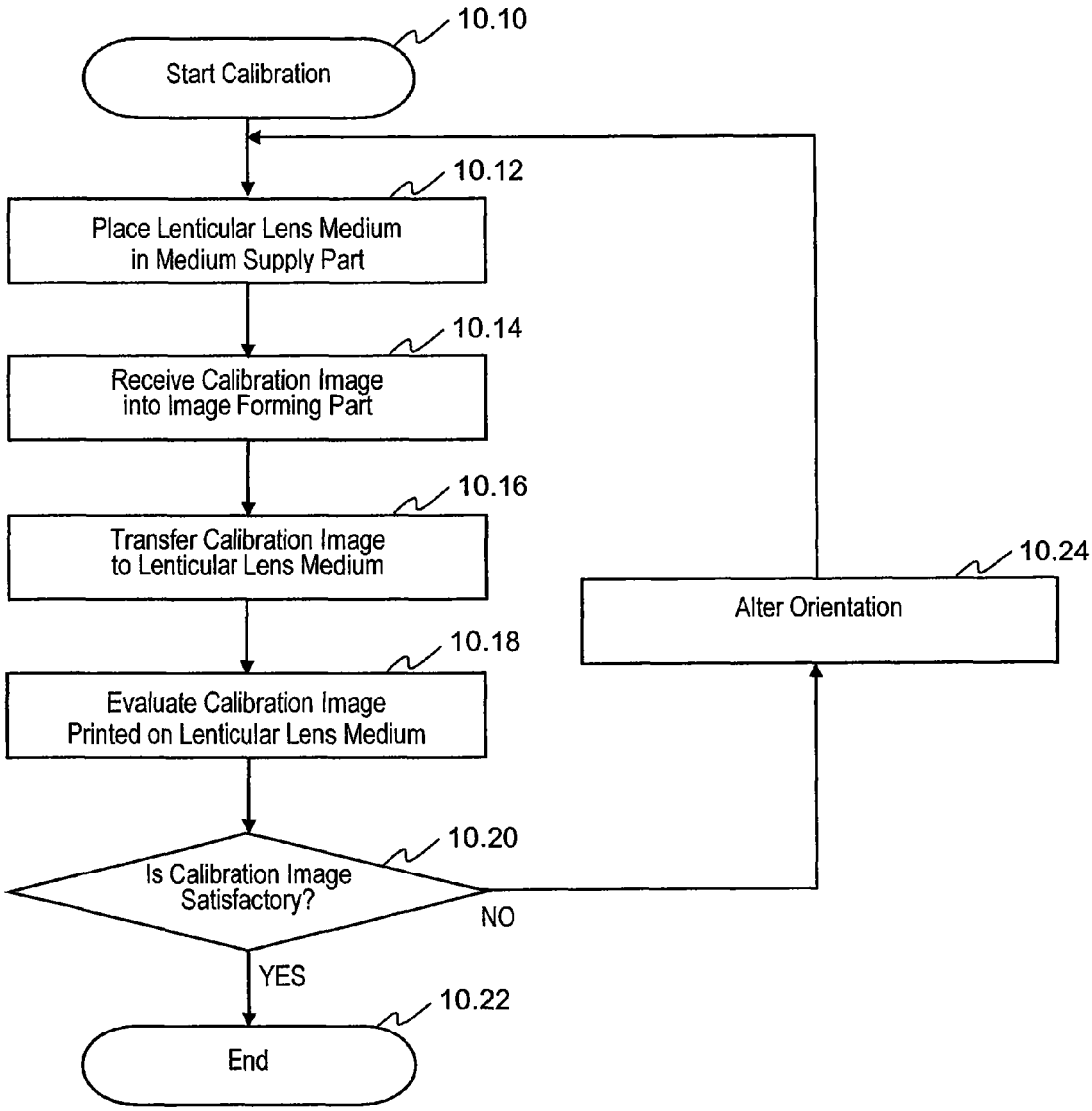
FIG. 10 is a flow diagram of a procedure for calibrating the printing apparatus according to the preferred embodiment.

Referring now to FIG. 10 there is shown a first preferred method of calibrating the color electrophotographic printer for printing the CMYK lenticular half tone image 8 on the lenticular lens medium 10. The method includes: (a) receiving a CMYK lenticular calibration image 8 into the image forming part 3; (b) receiving the lenticular lens medium 10 from the medium supplying part 70 into the image forming part 3; (c) transferring the CMYK half tone lenticular calibration image 8 to a surface of the lenticular lens medium 10; (d) evaluating the CMYK half tone lenticular calibration image 5 transferred to the lenticular lens medium; and (e) if the evaluation of the transferred lenticular image is not satisfactory, altering an angular alignment of the lenticular lens medium 10 held in the medium supply part 70 with respect to the CMYK half tone calibration image by operating the thumbscrew 736 in the requisite direction.

In more particularity, the alignment is performed by a user initiating a calibration computer program residing in the lenticular image former 14 (step 10.10), introducing a calibration lenticular lens medium 10 into the alignment assembly 73 (step 10.12) and initiating the calibration program in the image former 14 (step 10.14), whereby a special calibration image 9 is generated by the calibration program for printing on the calibration lenticular lens 10.

Figure 11:
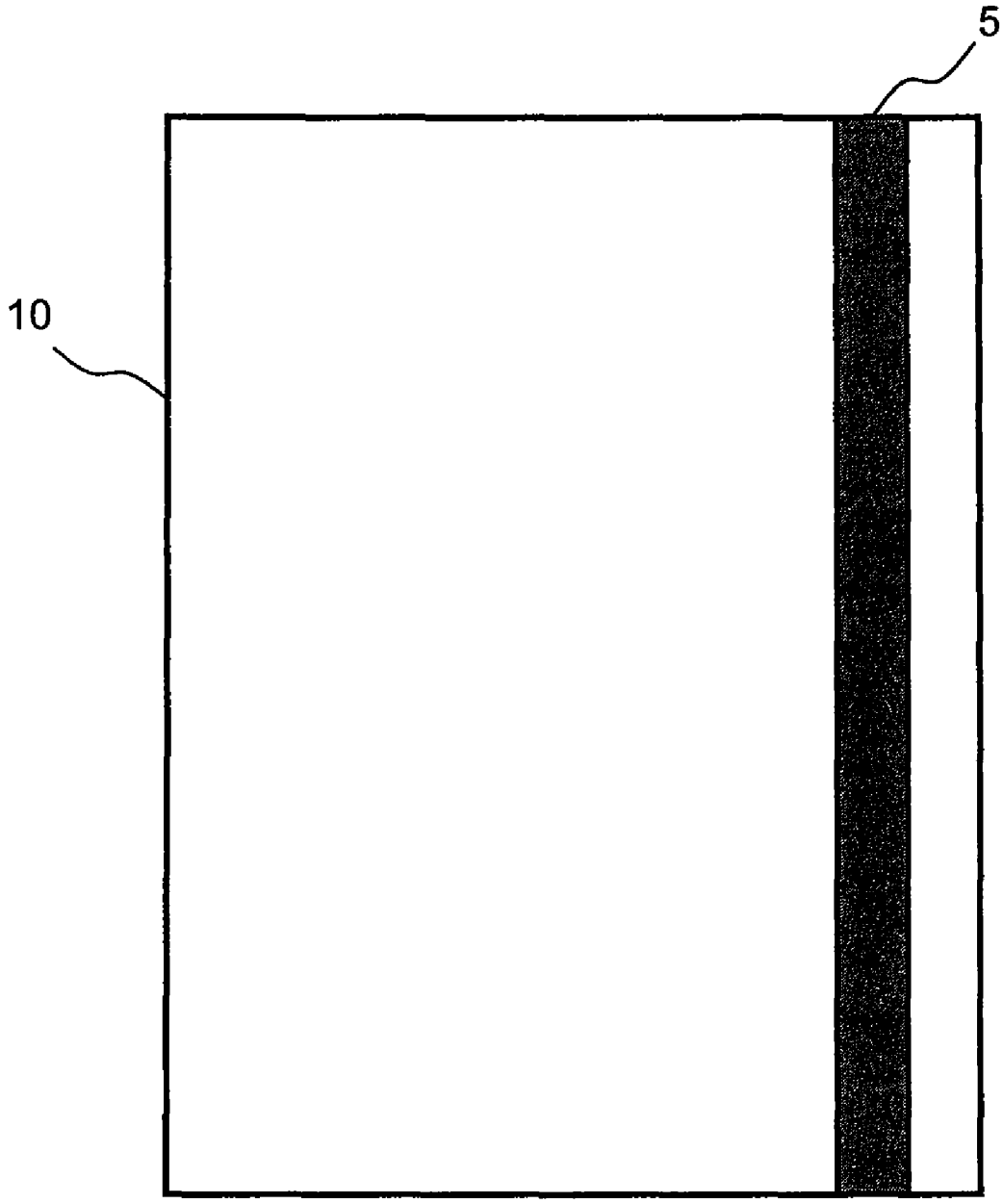
FIG. 11 is a front view of the lenticular lens medium showing a calibration bar.
Figure 11A:
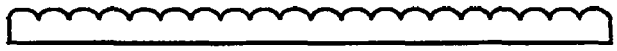
Figure 11B:
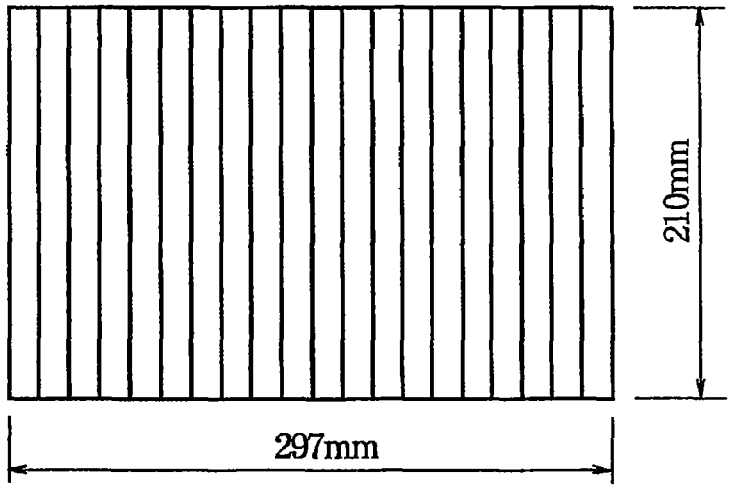

At step 10.16, the lenticular lens medium 10 is fed to the image forming part 3 and the calibration CMYK half-tone lenticular image 8 is transferred (printed) to the surface 16 of the lenticular lens medium 10. In the preferred embodiment, the calibration CMYK half tone image 8 is a mono-color image having the shape of a substantially straight bar parallel to the longitudinal axis 19 of the image forming part 3 within +/−one-half of the width Lp of a lenticule 13 over the length of the lenticular lens medium 10, having a width of approximately 20 lenticules and having a uniform print density of at least 1.4. FIG. 11 shows an example of the transferred calibration CMYK half tone lenticular image 5 as transferred to the calibration lenticular lens medium 10.

At step 10.18, the printed-on lenticular lens medium 10 is passed to the medium ejecting part 60 for visual evaluation by the user. At step 10.20, the lenticular lens medium 10 is evaluated by the user by viewing the bar 5 as printed on the lenticular lens medium 10. To be found satisfactory, the density of the bar 5 should be solid and uniform. If the bar 5 does not have a uniform density but has stripes of light and dark regions, it is an indication that the lenticules 13 of the lenticular lens medium 10 are skewed with respect to the CMYK half tone lenticular image 8 and the lenticular lens medium 10 is accordingly evaluated as not satisfactory. Preferably, the angular alignment of the calibration lenticular lens medium 10 is then altered to make the density of the bar 5 uniform.

In the preferred embodiment, the angle of the lenticular lens medium 10 in the alignment assembly 73 with respect to the longitudinal axis 19 (i.e. the CMYK half tone calibration image 8) is altered by a user actuating the thumbscrew 736 of the alignment assembly 73 to rotate the lenticular lens medium 10 about the pivot point at the pivot hole 742 (step 10.24). Preferably, the medium supplying part 60 includes an indicia 746 which indicates, based on comparison with a visual evaluation of the calibration lenticular image 5 printed on the lenticular lens medium 10 by the electrophotographic printer 2, a direction in which the second platform should be pivoted in order to improve the quality of the visual image produced by the lenticular based visualization device 6.

Preferably, steps 10.10 through 10.24 are repeated until the printed-on bar 5 has a uniform density, at which point the calibration procedure is completed (step 10.22). At the completion of the calibration process, the previously loosened lock down screw 741 is tightened in order to fix the angular alignment of the alignment assembly 73.

Preferably, the lenticular image former 14 is instructed at each repetition of the calibration process to print the bar 5 to be offset in the lateral direction from previous bars 5 such that the same calibration lenticular lens medium 10 can be used throughout the calibration process.

In the alternate embodiment, steps 10.10 through 10.20 are identical to those of the preferred embodiment. However, in step 10.24, instead of a user altering the angle of the lenticular lens medium 10, the angle of the CMYK half tone lenticular image 8 with respect to the longitudinal axis 19 (i.e. the lenticular lens medium 10) is altered at each repetition of the calibration process by user input to the lenticular image former 14. The lenticular image former 14 interacts with the image pattern generating part 90 which adjusts the ON-OFF timing of light emitting diodes (LEDS) to alter the angle of the CMYK half tone lenticular image 8. At the conclusion of the calibration process 10.22, the angular offset of the CMYK lenticular half tone image 8 from the longitudinal axis 19 determined from the calibration process is stored in the image pattern generating part 90 to be used until the calibration process is repeated.

The altering of the angle of the lenticular lens medium 10 in the alignment assembly 73 with respect to the longitudinal axis 19 is not limited to a user actuating the thumbscrew 736 of the alignment assembly 73 to rotate the lenticular lens medium 10 about the pivot point at the pivot hole 742. The angle of the lenticular lens medium 10 in the alignment assembly 73 can be altered, for example, by a user actuated lever which rotates the second platform 732 with respect to the first platform 731 about the pivot hole 742, or electromechanically be means of a motor actuating a screw assembly similar to the thumbscrew 736, or by a linear actuator which rotates the second platform 732 with respect to the first platform 731. Preferably, the electromechanical operation would be under the control of the image former 14 in conjunction with the print operation controlling part 80.

Figure 12:
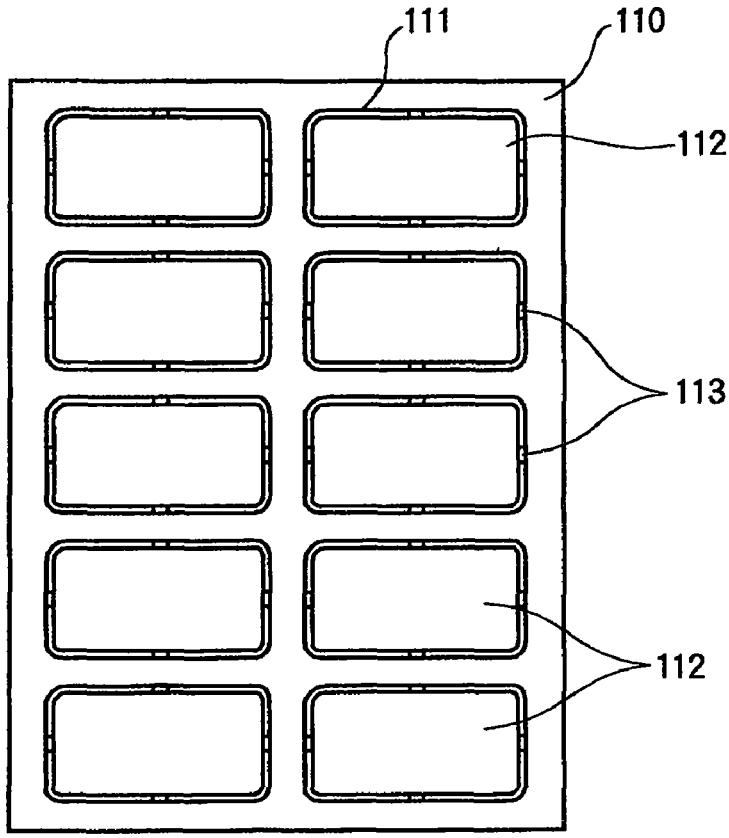
FIG. 12 is a front view of a lenticular based visualization device having multiple images as produced by the preferred embodiment of the present invention.

The printer system 1 for manufacturing the lenticular based visualization device 6 is not limited to printing a single CMYK half tone color lenticular image 8 on the lenticular lens medium 10, but as shown in FIG. 12, multiple CMYK half tone images 112 may be printed on a single lenticular lens medium 10, all of which may be identical or some or all may be different. Further, the CMYK half tone images need not be multicolored but may be an single color or black, with or without grayscale.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A color electrophotographic printing apparatus comprising:

a medium supplying part configured to hold a polymeric lenticular lens medium;

an image pattern generating part configured to receive a color lenticular image and to provide a CMYK half tone lenticular image;

an image forming part configured to: (1) receive the lenticular lens medium from the medium supplying part, (2) receive the CMYK half tone lenticular image from the image pattern generating part, and (3) transfer, using a powder type of toner, the CMYK half tone lenticular image to a rear surface of the lenticular lens medium; and a fixing part configured to fix the transferred CMYK image to the lenticular lens medium, wherein each CMYK color when it is transferred to and fixed on the rear surface of the lenticular lens medium has a printing density of at least 1.0.

2. The apparatus of claim 1, wherein the volume resistivity of the lenticular lens medium measured from a front surface to the rear surface is less than $1\times10^{14}$ ohm-cm.

3. The apparatus of claim 1, wherein the angular alignment of the lenticular lens medium held in the medium supplying part is alterable with respect to the CMYK half tone lenticular image.

4. The apparatus of claim 1, wherein the angular alignment of the CMYK half tone lenticular image is alterable with respect to the lenticular lens medium held in the medium supplying part.

5. The apparatus of claim 1, wherein the printing apparatus is configured to print on a lenticular lens medium having a thickness at least as large as 0.9 mm.

6. The apparatus of claim 1, wherein the lenticular lens medium lacks a toner adhesion coating.

7. The apparatus of claim 1, wherein the CMYK half tone lenticular image has respective CMYK screen angles of 105, 75, 30 and 15 degrees.

8. The apparatus of claim 1, wherein the medium supplying part comprises:

a feeding roller;

a first platform attached to the printer in a plane substantially parallel to the axis of the feeding roller; and a second platform attached to the first platform and pivotal in the plane of the first platform, said second platform holding said lenticular lens medium and providing means for altering the angle of the lenticular lens medium with respect to a longitudinal axis of the image forming part.

9. A method of producing a lenticular based visualization device by a color electrophotographic printing apparatus, said printing apparatus including a medium supplying part, an image forming part and a medium ejecting part, the method comprising the steps of:

receiving a CMYK lenticular image into the image forming part;

receiving a lenticular lens medium from the medium supplying part into the image forming part;

transferring the CMYK lenticular image to a surface of the lenticular lens medium;

fixing the transferred CMYK image such that each color when transferred to and fixed on the lenticular lens medium has a density of at least 1.0, and providing the lenticular based visualization device to the medium ejecting part.

10. The method of claim 9, wherein the volume resistivity of the lenticular lens medium measured from a front surface to the rear surface is less than $1\times10^{14}$ ohm-cm.

11. The method of claim 9, wherein the angular alignment of the lenticular lens medium held in the medium supplying part is alterable with respect to the CMYK half tone lenticular image.

12. The method of claim 9, wherein the angular alignment of the CMYK half tone lenticular image is alterable with respect to the lenticular lens medium held in the medium supplying part.

13. The method of claim 9, wherein the printing apparatus is configured to print on a lenticular lens medium having a thickness at least as large as 0.9 mm.

14. The method of claim 9, wherein the lenticular lens medium lacks a toner adhesion coating.

15. The method of claim 9, wherein the CMYK half tone lenticular image has respective CMYK screen angles of 105, 75, 30 and 15 degrees.

16. The method of claim 9, wherein the medium supplying part comprises:

a feeding roller;

a first platform attached to the printer in a plane substantially parallel to the axis of the feeding roller; and a second platform attached to the first platform and pivotal in the plane of the first platform, said second platform holding said lenticular lens medium and providing means for altering the angle of the lenticular lens medium with respect to a longitudinal axis of the image forming part.

17. An electrophotographic printing apparatus comprising:

a medium supplying part configured to hold a lenticular lens medium having a plurality of lenticules arranged in parallel to each other;

an image forming part; and an image pattern generating part configured to receive a lenticular image and to generate from the lenticular image, a half tone lenticular image, said half tone lenticular image being transferrable to the lenticular lens medium by the image forming part, said printing apparatus being configurable to align the lenticules of the lenticular lens medium with the half tone image by altering the angular relationship of the lenticular lens medium held in the image supplying part and the half tone image.

18. The electrophotographic printing apparatus of claim 17, wherein the angle of the lenticular lens medium held in the medium supplying part is alterable with respect to a longitudinal axis of the image forming part.

19. The apparatus of claim 17, wherein the angle of the half tone lenticular image is alterable with respect to a longitudinal axis of the image forming part.

20. The apparatus of claim 17, wherein the angular relationship is alterable to effect alignment of the lenticular lens medium with the half tone lenticular image to within one-half the width of a lenticule over the length and the width of the lenticular lens medium.

21. The apparatus of claim 17, wherein the medium supplying assembly comprises:

a feeding roller;

a first platform attached to the printer in a plane substantially parallel to the axis of the feeding roller; and a second platform attached to the first platform and pivotal in the plane of the first platform, said second platform holding said lenticular lens medium and providing means for altering the angle of the lenticular lens medium with respect to a longitudinal axis of the image forming part.

22. A method of calibrating a color electrophotographic printer for printing a lenticular image on a lenticular lens medium, said electrophotographic printer including a medium supplying part and an image forming part, the method comprising the steps of:

(a) receiving a CMYK half tone lenticular calibration image into the image forming part;

(b) receiving the lenticular lens medium from the medium supplying part into the image forming part;

(c) transferring and fixing the CMYK half tone lenticular calibration image to a surface of the lenticular lens medium;

(d) evaluating the transferred CMYK half tone lenticular calibration image; and (e) if the evaluation of the transferred and fixed CMYK half tone calibration image is not satisfactory, altering an angular alignment of the at least one of the lenticular lens medium held in the medium supplying part with respect to CMYK half tone calibration image and the CMYK calibration image with respect to the lenticular lens medium held in the medium supplying part.

23. The method of claim 22, wherein the transferred and fixed lenticular calibration image is evaluated visually.

24. The method of claim 22, wherein steps (a) through (e) are repeated until the transferred and fixed CMYK half tone image is satisfactory.

25. The method of claim 22, wherein the CMYK half tone calibration image is a substantially straight bar having a central axis parallel to the longitudinal axis of the image forming part and having a substantially uniform density.

26. The method of claim 25, wherein the density of the bar is at least 1.4.

27. The method of claim 22, wherein if the density of the transferred lenticular calibration image is determined to be other than substantially uniform density, the transferred CMYK half tone calibration image is not satisfactory and steps (a) through (e) are repeated until the transferred CMYK half tone image has a substantially uniform density.

28. A medium supplying assembly for feeding a medium to an electrographic printer comprising:

a feeding roller;

a first platform attached to the printer in a plane substantially parallel to the axis of the feeding roller; and a second platform attached to the first platform and pivotal in the plane of the first platform.

29. The medium supplying assembly of claim 28, further including indicia which indicates, based on comparison with a visual evaluation of a calibration lenticular image printed on the lenticular lens medium by the electrophotographic printer, a direction in which the second platform should be pivoted in order to improve the quality of a lenticular based visualization image.

30. A lenticular based visualization device comprising a layer of toner particles on a rear surface of a lenticular lens medium, said layer being produced from a powder toner by an electrophotographic printer, said toner layer forming a CMYK half tone lenticular image, the CMYK half tone image having respective screen angles of 105, 75, 30 and 15 degrees.

31. The lenticular based visualization device of claim 30, wherein the volume resistivity of the lenticular lens medium measured from a front surface to the rear surface is less than $1\times10^{14}$ ohm-cm.

32. The lenticular based visualization device of claim 30, wherein the lenticular lens medium is a substantially homogeneous polymeric material.

33. The lenticular based visualization device of claim 30, wherein the layer of toner particles is formed directly on the lenticular lens medium.

* * * * *